United States Patent [19]

Thompson

[11] Patent Number: 4,474,252

[45] Date of Patent: Oct. 2, 1984

[54] METHOD AND APPARATUS FOR DRILLING GENERALLY HORIZONTAL BORES

[76] Inventor: Farish R. Thompson, Rte. 1, Afton, Wyo. 83110

[21] Appl. No.: 497,602

[22] Filed: May 24, 1983

[51] Int. Cl.[3] ..... E21B 21/14

[52] U.S. Cl. ..... 175/69; 175/205

[58] Field of Search ..... 175/69, 70, 62, 65, 175/205, 212, 103; 173/73–76, 145, 146

[56] References Cited

U.S. PATENT DOCUMENTS

| | | | |
|---|---|---|---|
| 1,087,706 | 2/1914 | Bade | 175/75 |
| 3,107,738 | 10/1963 | Osborn | 173/74 |
| 3,369,617 | 2/1968 | Brack et al. | 175/62 |
| 3,640,350 | 6/1972 | Stenuick | 173/61 |
| 3,674,100 | 6/1972 | Becker | 175/69 |
| 3,736,994 | 6/1973 | Vida et al. | 175/69 X |

*Primary Examiner*—James A. Leppink
*Assistant Examiner*—Thuy M. Bui
*Attorney, Agent, or Firm*—Roland H. Shubert

[57] ABSTRACT

Means are provided to drill generally horizontal bores through heterogeneous fill and hard strata. A carriage providing power means to rotate a spindle is mounted on a generally horizontal track and is adapted to move longitudinally along the track. Swivel means about the spindle are provided with means to introduce a combined gas and liquid stream, suitably air and water, into a drill pipe connected to the spindle and through an impact drill mounted at the end of the drill pipe to power the drill and to flush cuttings from the hole.

19 Claims, 3 Drawing Figures

METHOD AND APPARATUS FOR DRILLING GENERALLY HORIZONTAL BORES

BACKGROUND OF THE INVENTION

This invention relates to a method and means for drilling generally horizontal bores under roadbeds and the like.

More specifically, this invention relates to a pneumatic rotary-impact drill utilizing a drilling fluid and to a method for its use.

There is often need for drilling generally horizontal bores under roadways, railroads and similar areas where it is important that the surface not be disturbed for the placement of utility lines, water mains, gas gathering lines and the like. Such techniques have long been practiced and a variety of commercial drills have been developed for such purposes.

Typical commercially available, horizontal drilling devices utilize a carriage-mounted power source arranged to move longitudinally on a pair of rails or track. The power source rotates a spindle at its forward end which is connected to an auger having a bit or cutter head mounted on it. A longitudinal force is exerted on the auger to cause it to penetrate the earth by means of a hydraulic cylinder acting between the carriage and the track.

As the auger penetrates the earth, cuttings torn free by the cutter head are conveyed from the bore by action of the spiral auger flights. When the carriage has progressed to the limits of its travel along the rails or track, the auger is disconnected from the carriage and the carriage is retracted backwardly along the rails. A new auger section is then attached to that section within the bore and is connected to the carriage spindle. This procedure is repeated until the bore is complete.

A drill of the type described works well when used in drilling bores through compacted earth, typical of many roadbeds, or through relatively soft, homogeneous strata. However, when a drill of this sort is used in an attempt to drill a bore through a compacted, heterogeneous material such as a cobble or boulder-filled roadbed, great difficulties ensue. Upon striking a boulder or large cobble, the cutter head is often deflected causing the auger flights to enlarge the bore even to the point of causing the bore to collapse trapping the auger within the hole. If the deflection is very large, particularly if the cutter head is deflected either upwardly or downwardly, the hole must be abandoned and relocated. Cutter heads used with the typical auger drills do not have a practical capability of penetrating hard rock such as granites, tightly cemented sandstones and the like. All of these circumstances, cobble and boulder filled roadbeds, hard rock and the like, are common in portions of this country, particularly in the Rocky Mountain states. Consequently, there has developed a pressing need for drills which can bore straight horizontal holes through heterogeneous strata and hard rock.

Auger drills are also used in drilling vertical bores, particularly for soils testing, foundation work and the like, but more commonly rotary drills are used for this purpose as also are impact drills. Impact drills used for drilling vertical bores typically are powered by a compressed gas stream delivered to the drill through the drill pipe. The drill pipe and impact hammer may, in some instances, be rotated with the drill string during operation.

It has been proposed to provide a flow of liquid, water or other drilling fluid, to the bottom of the bore to aid in flushing cuttings from the hole when using an impact drill. This technique requires that the liquid and gas streams be separately conveyed down the hole with the air or gas stream passing through the impact drill while the liquid stream is directed to the working face of the bore. Such an arrangement has serious practical disadvantages. It requires a double-walled drill pipe or equivalent arrangement to convey separate streams of liquid and gas down the hole and it requires some method for directing the liquid stream around the drill and discharging it at the cutting face. Because of these practical difficulties, the advantages of combining rotary and impact forces to a drill bit and of combining an air or other gas stream to power the impact drill with a water or other liquid stream to condition the hole and to flush cuttings therefrom have seldom been realized.

SUMMARY OF THE INVENTION

A method and apparatus for drilling horizontal bores using both impact and rotary forces on the drill bit and using both gas and liquid as drilling fluids is provided. A pneumatic impact drill having a reciprocating piston-hammer is rotated at the end of a drill pipe while supplying to the drill and passing through the drill a combined flow of gas and liquid, typically air and water. The drill assembly finds particular advantage when drilling through heterogeneous fill material which precludes effective use of a conventional auger-type drill.

Hence, it is an object of this invention to provide an improved method and means for drilling horizontal bores.

It is another object of this invention to provide means for efficiently drilling through heterogeneous strata.

Other objects of this invention will be apparent from the following description of certain preferred embodiments.

DESCRIPTION OF THE DRAWING

Specific embodiments of the invention are illustrated in the drawing in which.

DESCRIPTION AND DISCUSSION OF THE INVENTION

Figure 1:
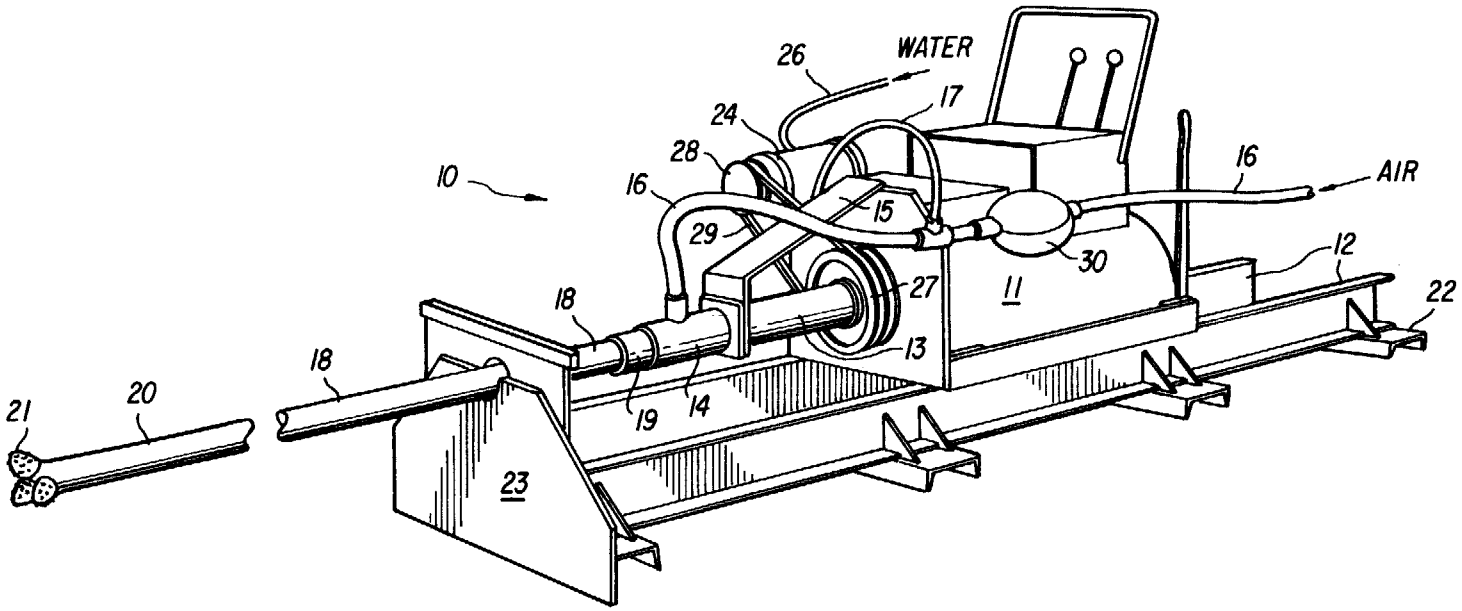
FIG. 1 is a perspective side view of a drill assembly in accordance with this invention.

The invention will be described in greater detail with reference to the drawing. Referring now to FIG. 1, the drill assembly of this invention is shown diagrammatically at 10. The assembly includes a carriage 11 adapted to move longitudinally along a track or rails 12. Carriage 11 comprises a power source, typically an internal combustion engine, to rotate spindle 13 at a relatively slow rate and to move the carriage forward and backward along the track.

A swivel 14 surrounds the forward portion of spindle 13 and is held stationary by bracket means 15 connecting between the swivel and the carriage housing or frame. Conduit 16, preferably a flexible hose, connects into the swivel and delivers fluid into the tubular interior of the spindle 13. Conduit 16 is connected to a source of pressurized gas (not shown) which ordinarily is an air compressor. A stream of liquid which may be water is also introduced into the interior of the spindle through the swivel by way of side conduit 17 which conveniently may join hose 16 forward of its connection to the swivel. The combined gas and liquid streams pass through one or more sections of drill pipe 18 connected to spindle 13 by means of threaded sub 19 and thence through pneumatic impact drill 20 and exiting through ports in the body of bit 21.

It is to be noted that the combined gas and liquid, typically air and water, streams pass through pneumatic impact drill 20. It is conventional practice and wisdom in the art to avoid and prevent water from entering a pneumatic impact drill. However, if done in accordance with the teachings of this invention, the impact drill mechanism is unharmed and the drilling results are substantially improved. Faster drilling rates are obtained and, when drilling through heterogeneous fill, the sides of the bore hole are much less prone to spall or cave.

Figure 2:
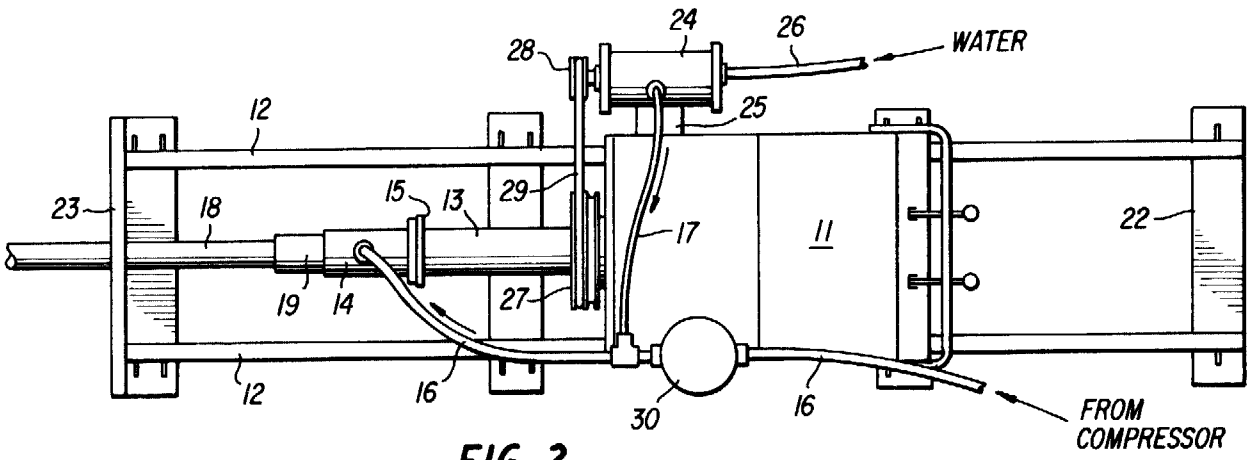
FIG. 2 is a plan view of the drill assembly illustrating certain preferred embodiments.

Referring now to FIG. 2, there is shown a diagrammatic plan view of the drill assembly illustrating certain other features. The rails or track 12 upon which carriage 11 is mounted are held in a spaced and aligned attitude by means of cross-members 22 and 23. Cross-member 23 preferably is disposed at the forward end of the track and includes means for supporting and guiding the drill stem. A pump 24 may be mounted to one side of the carriage by means of bracket 25. An inlet to the pump is supplied with water from any convenient source by way of conduit 26. Pump 24 delivers a metered flow of water for injection through conduit 17 into air hose 16 at a pressure at least equal to the air pressure in the hose which typically will be 150 psi or greater. The pump may be driven by a variable speed hydraulic motor allowing ready adjustment of the water flow rate to the air hose 16 and thence to the impact drill.

In a presently preferred arrangement, pump 24 is driven by the rotation of spindle 13 through a belt or chain drive. Pulley 27 in this embodiment is mounted coaxially with spindle 13 and drives pulley 28 mounted on pump 24 through belt 29. The water flow delivered by pump 24 may be adjusted by changing the relative size of pulleys 27 and 28 and by adjusting the rotational speed of spindle 13.

This arrangement has certain advantages to the operation of the drill assembly. The spindle, drill pipe and pneumatic impact drill are rotated during the actual drilling operation. So, water or other liquid is injected into the air stream only while the spindle is turning and drilling is in progress. When drilling ceases, the continuing air flow flushes water out of the impact drill and avoids flooding the hole with water during pauses in the drilling operation.

It is also preferred to place an oiler 30 in air line 16 to introduce a fine mist of oil into the air stream for the purpose of providing lubrication to the impact drill. This is conventional practice in the operation of pneumatic impact drills and the oil appropriately used for this purpose is that commonly employed and known in the trade as air hammer oil. It has been found that the water introduced through line 17 into the air line and passed through the drill does not adversely affect the lubrication of the drill.

Figure 3:
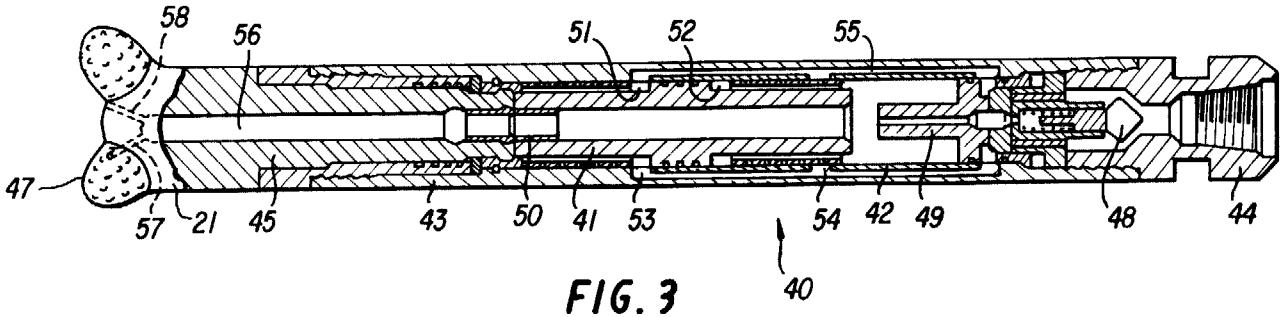
FIG. 3 is a sectional view of an impact drill suitable for use with the assembly of FIGS. 1 and 2.

Turning now to FIG. 3, there is shown in cross section one commercial pneumatic drill which may be used, with some modification, in the practice of this invention. Impact drills suitable for use in this invention are those characterized in having a relatively heavy, reciprocating piston-hammer which delivers impact blows to a bit or cutting head. The impact drill depicted in FIG. 3 is of the type sold under the designation Megadril and manufactured by Mission Mfg. Co. of Houston, Tex. Another commercially available pneumatic impact drill suitable for use, with some modification, in the practice of this invention is that sold under the name Halco DH. 325 manufactured by Halifax Tool Co. Ltd., Halifax, England.

The impact drill, designated generally at 40, comprises a heavy piston 41 sliding back and forth within piston sleeve 42. The drill is of overall cylindrical configuration defined by drill case 43 into which threadably connects top sub 44 which is adapted to accept the end of a section of drill pipe. Disposed at the lower end of the drill case is bottom or driver sub 45 which, on its top surface, accepts the impact blows of the reciprocating piston 41 and on its other end is adapted for threadable connection to an oil well bit 21, preferably of the tricone type, having three generally cone shaped cutting members 47 journaled for free rotation. A check valve 48 is disposed in the top portion of the drill body to prevent reverse flow of fluid through the drill.

Two additional stationary valves, top rigid valve 49 and foot valve 50 act in cooperation with the moving piston to arrest its upward movement and to again propel the piston upwardly after delivering an impact blow to driver sub 45. As may be discerned by following the fluid flow paths defined by piston 41 in various positions over the extent of its travel, air under pressure is caused to first direct the piston downwardly to strike an impact blow to the driver sub and then to force the piston upwardly. Cylindrical grooves 51 and 52 formed in the piston body align with ports 53 and 54 to allow air to pass from annular channel 55 and act upon the piston either in an upward or downward direction depending upon its position.

Bottom or driver sub 45 is provided with an axial bore 56 through which all of the fluid, air and water, introduced into the drill pass. Bore 56 aligns with channels 57 and 58 within the body of bit 46 to direct the fluid flow to the cutting face of the bore. The water exiting the drill bit tends to cool and to lubricate cutting members 47 and, along with the air stream, to carry cuttings away from the drill face. Both water and air exit the bore through the annulus between the exterior of the drill pipe and the bore wall carrying cuttings out of the hole with the flow of the combined fluids.

An important function of the water, or other drilling fluid, introduced into the air stream is to consolidate and densify the surface of the bore wall. When drilling through unconsolidated materials, typical of fill materials in roadbeds, the use of air alone tends to severely erode the bore. Bore erosion, particularly if the hole becomes significantly enlarged, creates a number of problems. Erosion of this sort can cause the hole to cave sticking the drill within the hole. If caving occurs after the drill is withdrawn then it becomes impossible to route a conduit or pipe through the hole. If caving occurs after the conduit is in place, then there is danger that pavement or track atop a roadbed will subside thus negating the advantages of drilling for placement of a line or conduit rather than trenching.

The method and apparatus of this invention can be used to drill horizontal bores having a range of sizes. Although bores as large as 12 to 16 inches in diameter can be drilled without difficulty, it is more common to require a bore diameter of about four to six inches for the placement of utility conduits, gas gathering lines and similar facilites. In its most generally practical form, the drill assembly will utilize 4-inch drill pipe of the same type as used in oil well drilling. Length of drill pipe sections is determined by the length of carriage travel along track 12; a distance typically of some six to eight feet. Bit size used must be somewhat larger than the drill pipe; a 4⅝ inch tri-cone bit being appropriate and desirable to use with four inch drill pipe.

The flow rate of water or other drilling liquid used is set according to the following considerations. Flow rate must be less than that which will flood out the impact drill or interfere significantly with its efficient operation. That rate depends upon the size of the drill, the rate of air flow through the drill, and to some extent upon the particular type and model of drill used. Maximum practical water flow rates may be determined by simple experimentation. It is desirable to set the water flow at a rate such that a small trickle of water flows from the drill hole while drilling is in progress. When using the system described in this specification with a four-inch drill pipe and a 4⅝-inch tri-cone bit, water flow rates will range generally from about 0.2 to about 10 gallons per minute and more usually from about 0.5 to about 5 gallons per minute. A compressor having a capacity of 375 cfm at 150 psi will adequately service the drill assembly described.

Use of this invention has allowed the routine completion of a bore through a sixty foot wide roadbed during an eight-hour shift. This includes digging the access holes on either side of the roadbed for placement of the drill assembly and casing of the bore. The results referred to were obtained in drilling through a cobble and boulder-filled roadbed. In contrast, an attempt to drill through the same type of roadbed using an auger drill of conventional type encompassed some three weeks of effort before a bore could be successfully completed and cased.

After finishing drilling a bore hole, it is desirable to operate the drill briefly with air alone to blow all of the water out of the impact drill. This result is achieved in a semi-automatic fashion in the preferred embodiment described in which the liquid pump is rotationally coupled to the spindle. It is also desirable to further insure against internal corrosion of the pneumatic impact drill between periods of use by pouring a quantity of air hammer oil, a quart or so, into the drill after use. Residual oil is readily blown from the drill by the air flow when the drill is next used.

Although it is expected that this invention will find primary use in drilling bores through roadbeds and for similar purposed, its application is not so limited. It is applicable as well for the drilling of horizontal bores for any other purpose as will be apparent to those skilled in the art.

I claim:

1. A machine for drilling substantially horizontal bores under a roadbed or the like comprising:

a carriage including a power source adapted to rotate a drill pipe;

a track extending longitudinally forward of said carriage, said carriage adapted to move along said track;

a tubular spindle connected at one end to said power source and rotated thereby, the other end of said spindle adapted for connection to a section of drill pipe;

a swivel mounted on the forward end of said carriage surrounding said spindle and arranged to deliver a stream of compressed gas into the interior of said tubular spindle;

means to introduce a metered flow of liquid into said stream of compressed gas;

a tubular drill pipe connected to the forward end of said spindle, said drill pipe adapted to transport the combined stream of said liquid and compressed gas therethrough to the other end of said drill pipe;

a pneumatic impact drill mounted on the other end of said drill pipe and adapted to receive said stream of liquid and compressed gas, said impact drill having a reciprocating piston-hammer activated by the passage of gas under pressure therethrough; and bit means mounted at the driver end of said impact drill, said bit means having fluid ports for the passage of gas and liquid therethrough and adapted to penetrate rock while rotating and while being subjected to impact blows delivered by said piston-hammer.

2. The machine of claim 1 wherein said liquid is water and including means to introduce a lubricant into said gas stream.

3. The machine of claim 2 wherein said lubricant is introduced into said gas stream prior to introduction of said water into the gas stream.

4. The machine of claim 1 wherein said means to introduce a metered flow of liquid into said gas stream comprises a pump.

5. The machine of claim 4 wherein said pump is rotatably connected to said spindle and is powered thereby.

6. The machine of claim 5 wherein the liquid outlet of said pump is introduced into said gas stream at a point upstream of said swivel.

7. The machine of claim 1 wherein said bit means comprises a tri-cone bit.

8. A method for drilling a substantially horizontal bore comprising:

rotating a pneumatic impact drill having a bit attached to the driver end thereof and moving said drill in a longitudinal direction into an earth strata thereby causing the bit to cut a bore hole;

delivering a gas stream to said impact drill at a pressure and flow rate sufficient to cause said drill to deliver axially directed impact energy to said bit;

introducing a liquid stream into said gas stream prior to its entry into said drill;

passing both said liquid and said gas streams through said drill;

porting the combined liquid and gas streams exiting the drill through said bit; and transporting cuttings out of the bore with the exiting liquid and gas streams.

9. The method of claim 8 wherein said liquid is water and wherein said gas is air.

10. The method of claim 9 wherein said water stream is introduced into said air stream only while said impact drill is rotating.

11. The method of claim 9 wherein the water flow rate is adjusted to provide a small trickle of water exiting the bore hole while drilling is in progress.

12. The method of claim 11 wherein said water flow rate is in the range of about 0.2 to 10 gallons per minute.

13. The method of claim 12 wherein said water flow rate is in the range of about 0.5 to 5 gallons per minute.

14. The method of claim 9 wherein a lubricant is introduced into said air stream.

15. The method of claim 14 wherein said lubricant is an air hammer oil.

16. The method of claim 9 wherein said bit is a tricone bit.

17. The method of claim 9 wherein said earth strata comprises an unconsolidated, heterogeneous deposit.

18. The method of claim 17 wherein said strata comprises the fill of a roadbed containing rock of cobble size or larger.

19. The method of claim 9 wherein said air is provided by a compressor at a pressure of at least 150 psi.

* * * * *